US005679040A

United States Patent [19]

Bianchi-Holm

[11] Patent Number: 5,679,040

[45] Date of Patent: Oct. 21, 1997

[54] APPARATUS AND METHOD FOR SUPPORTING A USER

[75] Inventor: Leah M. Bianchi-Holm, Scottsdale, Ariz.

[73] Assignee: Roger Davis, Tempe, Ariz.; a part interest

[21] Appl. No.: 503,822

[22] Filed: Jul. 18, 1995

[51] Int. Cl.[6] ..... B63C 9/08

[52] U.S. Cl. ..... 441/129; 5/930; 5/710

[58] Field of Search ..... 5/455, 465, 462, 5/930, 706, 681, 710; 441/129, 131, 136; 114/345; D6/604

[56] References Cited

U.S. PATENT DOCUMENTS

| | | | |
|---|---|---|---|
| D. 335,999 | 6/1993 | Van Driessche | 5/930 |
| 2,939,158 | 6/1960 | Baker | 44/129 |
| 3,068,494 | 12/1962 | Pinkwater | 441/129 |
| 3,988,793 | 11/1976 | Abitbol | 5/930 |
| 4,054,960 | 10/1977 | Pettit et al. | 5/930 |
| 4,737,999 | 4/1988 | Halverson | 5/930 |

*Primary Examiner*—Edwin L. Swinehart

*Attorney, Agent, or Firm*—Harry M. Weiss; Jeffrey D. Moy; Harry M. Weiss & Associates, P.C.

[57] ABSTRACT

An apparatus and method for supporting a pregnant user is disclosed comprising, in combination, a fixed support portion having a fixed configuration for supporting a portion of the user, and a variable support portion coupled to the fixed support portion and having a plurality of configurations for supporting a different abdominal portion of the user with each configuration of the plurality of configurations. The fixed support portion comprises a plurality of interconnected, inflatable, tubular members. The variable support portion comprises a plurality of independent, concentric, inflatable, annular members attached to an independent, inflatable, cylindrical member. The variable support portion is in proximity to the abdomen of a user lying thereon, and the cylindrical member and the annular members are selectively inflated to conform comfortably to a protruding abdomen of a pregnant user. This support apparatus is especially useful as an air mattress and a floatation raft.

1 Claim, 1 Drawing Sheet

APPARATUS AND METHOD FOR SUPPORTING A USER

BACKGROUND OF THE INVENTION

1. Field of the Invention

This invention is in the field of floating rafts and air mattresses and methods therefor and, more particularly, is an apparatus and a method for supporting a prone user on a floating raft or an air mattress.

2. Description of the Related Art

Pregnant women oftentimes find it extremely difficult to sleep comfortably, if at all. The primary reason for this dilemma is well known. They cannot lie on their back or stomach for very long. In the later stages of pregnancy, a woman's abdomen typically protrudes a substantial amount, and lying on her stomach means that she balances her weight on her stomach. This is a difficult, and possibly painful, task at best. Lying on her back is little better because the weight in her abdominal region pushes down upon her, so most women also find this sleeping position cumbersome and uncomfortable. Of course, a woman's difficulties in attempting to sleep in either of these positions presumes that she lays on a flat bed or other sleeping surface, and therein lies the problem—a flat sleeping surface. Therefore, there existed a need to provide an air mattress and floatation raft apparatus having a variable support portion in proximity to a user's abdomen and a method therefor.

SUMMARY OF THE INVENTION

An object of the present invention is to provide a comfortable floatation raft for a pregnant user and a method therefor.

Another object of the present invention is to provide an air mattress that enables a pregnant user to comfortably lie thereon in the prone position and a method therefor.

BRIEF DESCRIPTION OF THE PREFERRED EMBODIMENTS

In a preferred embodiment of the present invention, an apparatus for supporting a user is disclosed comprising, in combination, fixed support means having a fixed configuration for supporting a portion of the user, and variable support means coupled to the fixed support means and having a plurality of configurations for supporting a different abdominal portion of the user with each configuration of the plurality of configurations. The fixed support means comprises a plurality of tubular member means for inflating with a fluid such as air for supporting the user, and each tubular member means of the plurality of tubular member means has a tubular cavity. Moreover, each tubular cavity is in communication with an adjacent, tubular cavity.

The variable support means comprises annular member means having an outer circumferential portion coupled to the fixed support means for selectively inflating with a fluid such as air for supporting a first abdominal portion of the user, and cylindrical member means having an outer circumferential portion coupled to an inner circumferential portion of the annular member means for selectively inflating with the fluid for supporting another abdominal portion of the user located adjacent the first abdominal portion of the user. The annular member means comprises a plurality of concentric, annular members each having an independent annular cavity, and the cylindrical member means comprises a cylindrical member having an independent cylindrical cavity.

The fixed support means further includes headrest member means comprising a tubular member orthogonally coupled to the plurality of tubular member means and having an independent, tubular cavity for inflating with the fluid for supporting the user's head. The apparatus further includes inflation means coupled to the fixed support means, the headrest member means, and the variable support means for inflating and sealing the fixed support means, the headrest member means, and the variable support means.

In another embodiment of the present invention, a method for supporting a user is disclosed comprising the steps of providing fixed support means having a fixed configuration for supporting a portion of the user, and coupling variable support means having a plurality of configurations to the fixed support means for supporting a different abdominal portion of the user with each configuration of the plurality of configurations. The step of coupling the variable support means comprises the step of attaching an outer circumference of the variable support means to a portion of the fixed support means. The step of providing the fixed support means comprises the step of linking a plurality of tubular member means together for inflating with a fluid such as air for supporting the user. Each tubular member means of the plurality of tubular member means has a tubular cavity, and each tubular cavity is in communication with an adjacent, tubular cavity.

The step of coupling the variable support means comprises the steps of coupling an outer circumferential portion of annular member means to the fixed support means for selectively inflating with a fluid such as air for supporting a first abdominal portion of the user, and coupling an outer circumferential portion of cylindrical member means to an inner circumferential portion of the annular member means for selectively inflating with the fluid for supporting another abdominal portion of the user located adjacent the first abdominal portion of the user. The annular member means comprises a plurality of concentric, annular members each having an independent annular cavity, and the cylindrical member means comprises a cylindrical member having an independent cylindrical cavity.

The step of providing the fixed support means further includes the step of orthogonally coupling headrest member means comprising a tubular member to the plurality of tubular member means and having an independent, tubular cavity for inflating with the fluid for supporting the user's head. This method further includes the step of providing inflation means coupled to the fixed support means, the headrest member means, and the variable support means for inflating and sealing the fixed support means, the headrest member means, and the variable support means.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
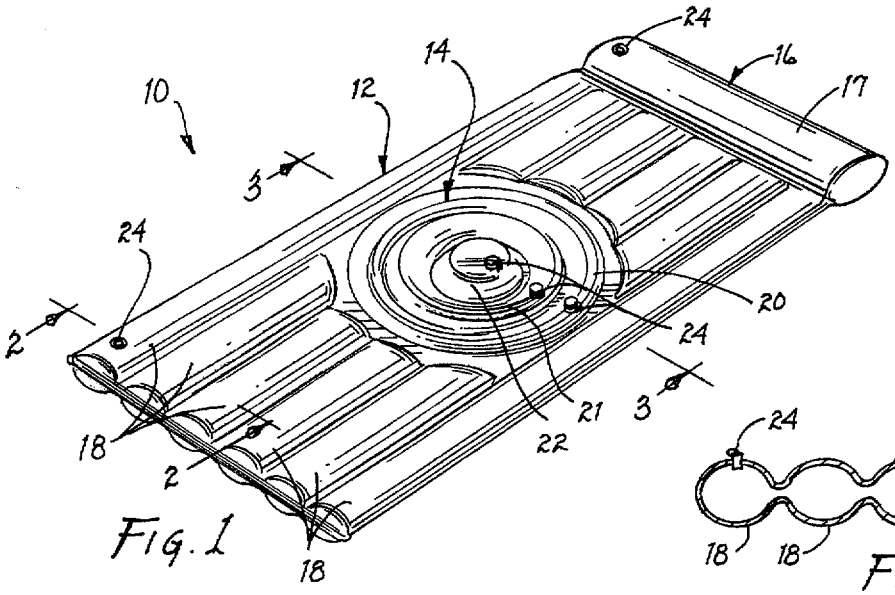
FIG. 1 is a perspective view of the instant invention for use as a floatation raft, an air mattress, or an equivalent thereof.

Referring to FIG. 1, a perspective view of the instant invention for use, preferably, as a floatation raft or an air mattress is shown and generally referred to by reference number 10. Although the instant invention 10 may be used as a floatation raft, an air mattress, or equivalents thereof, it will be simply referred to as the support apparatus 10 hereinafter.

Viewing the support apparatus 10 broadly, it is comprised of a fixed support portion 12 having a fixed configuration for supporting a portion of a user, and a variable support portion 14 coupled to the fixed support portion 12 and having a plurality of configurations for supporting a different abdominal portion of the user with each configuration of the plurality of configurations. Note that the fixed 12 and the variable 14 support portions are substantially coplanar. The fixed support portion 12 comprises a plurality of tubular members 18 for inflating with a fluid such as air for supporting the user. Note, each tubular member 18 has a tubular cavity, and each tubular cavity is in communication with an adjacent, tubular cavity (see FIG. 2). Accordingly, only one inflation nozzle 24 is required for inflating the plurality of tubular members 18. The tubular members 18 can be made of a rubber like material, a rubber like material having a canvas covering, or equivalents thereof, but in any case, manufacturing tubular members 18 out of such materials to form floating rafts and air mattresses is well known in the art.

Still in reference to FIG. 1, the variable support portion 14 comprises an annular member portion 20 and 21 having an outer circumference thereof coupled to the fixed support portion 12, and a cylindrical member 22 having an outer circumference thereof coupled to an inner circumference of the annular member portion 20 and 21. The variable support portion 14 is selectively inflated with a fluid such as air for supporting different regions of a user's abdomen and regions in proximity thereto. The annular member portion 20 and 21 comprises a plurality of concentric, annular members 20 and 21 each having an independent annular cavity, and the cylindrical member 22 comprises a cylindrical member having an independent cylindrical cavity. In this context, independent cavity means that it is not in fluid communication with an adjacent cavity. The concentric relationship of the cylindrical member 22 with the annular members 20 and 21 in combination with the independence of the cylindrical cavity and the annular cavities permits the variable support portion 14 to have a plurality of configurations for supporting a different abdominal portion of the user with each configuration. In particular, the variable support portion 14 is generally located where a user's abdomen rests providing the user is lying in a prone position. Moreover, with respect to the cavities associated with the variable support portion 14, the user could inflate all of the cavities, none of the cavities, or any number therebetween to provide different configurations of the variable support portion 14 for supporting different parts of the user's abdomen. Note that each cavity of the variable support portion 14 has its own inflation nozzle 24. Like the tubular members 18, the annular members 20 and 21 and the cylindrical member 22 can be made of a rubber like material, a rubber like material having a canvas covering, or equivalents thereof, and in any case, manufacturing members 20–22 out of such materials to form floating rafts and air mattresses is well known in the art.

The fixed support portion 12 further includes a headrest member portion 16 comprising a tubular member 17 orthogonally coupled to the plurality of tubular members 18 and having an independent, tubular cavity for inflating with a fluid such as air for supporting the user's head. The headrest member portion 16 is independent from the plurality of tubular members 18, and therefore, it has its own inflation nozzle 24. The headrest member portion 16 can also be made of a rubber like material, a rubber like material having a canvas covering, or equivalents thereof in any manner well known in the art for manufacturing such materials to form floating rafts and air mattresses.

Figure 2:
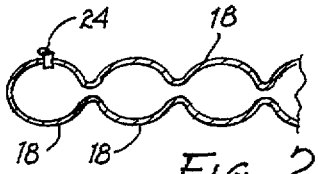
FIG. 2 is a cross-sectional view of the instant invention taken along the line 2—2 of FIG. 1.

The cross-sectional view shown in FIG. 2 reveals that the cavities of the tubular members 18 are in fluid communication with each other. Thus, only one inflation nozzle 24 is required to fill the cavities of the tubular members 18 with air. Note, that if desired, independent tubular members 18 could be used; however, multiple inflation nozzles would then be required for the tubular members 18. Also, note that the fixed support portion 12 uses 6 tubular, parallel members 18; however, different numbers of tubular members 18 could be implemented if desired, and non-parallel arrangements could also be introduced. Similarly, the variable support portion 14 shows one cylindrical member 22 and two annular members 20 and 21; however, if desired, one could create a variable support portion 14 having more or less annular members, or even no cylindrical member 22 at all (i.e. only annular members).

Figure 3:
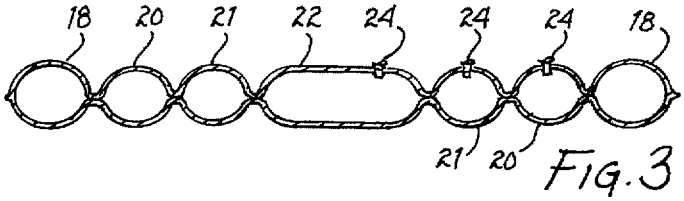
FIG. 3 is a cross-sectional view of the instant invention taken along the line 3—3 of FIG. 1.

Referring to FIG. 3, a cross-sectional view of the support apparatus 10 reveals one configuration of the variable support portion 14, namely, having the cylindrical cavity and all of the annular cavities inflated. This configuration of the variable support portion 14 is, in effect, providing uniform support across a user's abdomen.

Figure 3A:
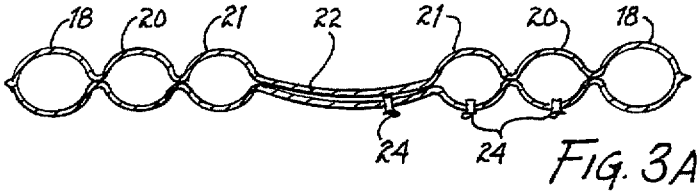
FIG. 3A is a widthwise cross-sectional view of the instant invention showing a part of the variable support portion in a deflated condition.

Referring to FIG. 3A, a cross-sectional view of the support apparatus 10 reveals another configuration of the variable support portion 14 having the cylindrical cavity deflated and all of the annular cavities inflated. This configuration of the variable support portion 14 provides support of a portion of a user's abdomen adjacent to and surrounding a protrusion associated with pregnancy. Additionally, if desired in the early stages of pregnancy when the stomach protrudes only very slightly, one could only partially deflate the cylindrical cavity, thereby providing some support for the corresponding portion of the user's abdomen.

Figure 3B:
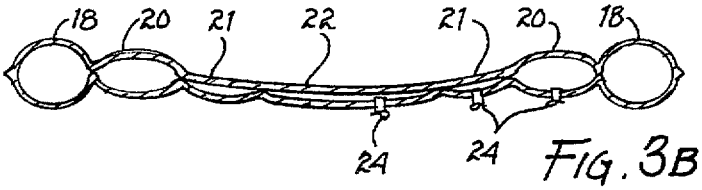
FIG. 3B is a widthwise cross-sectional view of the instant invention showing a larger part of the variable support portion in a deflated condition.

Referring to FIG. 3B, a cross-sectional view of the support apparatus 10 reveals yet another configuration of the variable support portion 14 having the cylindrical cavity and the inner annular cavity deflated and the outer annular cavity inflated. This configuration of the variable support portion 14 provides support of another portion of a user's abdomen adjacent to a protrusion associated with pregnancy. Again, if desired, one could only partially deflate the cylindrical cavity and/or any of the annular cavities for tailor fitting the variable support portion 14 to the unique shape of a user.

Figure 4:
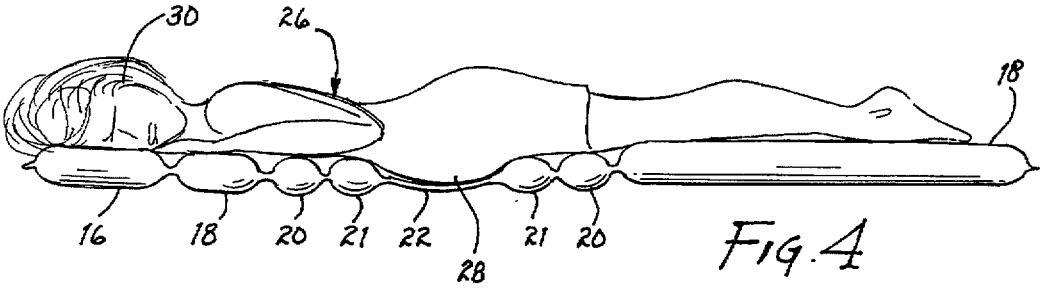
FIG. 4 is a lengthwise cross-sectional view of the instant invention showing a pregnant user lying thereon. Note that, part of the variable support portion is in a deflated condition.

Referring to FIG. 4, a lengthwise cross-sectional view of the support apparatus 10 is shown with a pregnant user 26 lying thereon. Note that the cylindrical member 22 of the variable support portion 14 is in a deflated condition in order to permit a protruding portion 28 of the user 26 to rest comfortably in the recess formed by deflating the cylindrical member 22. Note also that the head 30 of the user 26 rests on the headrest member portion 16.

Figure 5:
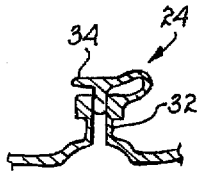
FIG. 5 is a cross-sectional view of one of the inflation nozzles of the instant invention.

Referring to FIG. 5, a cross-sectional view of an inflation nozzle 24 is shown. A seal 34 is removed for inflating the applicable cavity via the nozzle 32, and when the cavity is filled, the seal 34 is closed as shown in FIG. 5. Note that the support apparatus 10 has several inflation nozzles 24, and each one is similar to the one shown in FIG. 5.

Note that while the manufacturing skills necessary to produce the support apparatus 10 are well known in the art, the combination of features provided by the support apparatus 10 are new to the art of air mattresses, floatation rafts, and the like.

OPERATION

The user opens the seal 34 associated with the headrest member portion 16 and inflates the tubular cavity therein by blowing air into the cavity with the mouth or other means. When the desired level of inflation is attained, the user closes seal 34. In a similar manner, the user fills the tubular cavities associated with the plurality of tubular members 18. In a similar manner, the user inflates the desired cavities associated with the variable support portion 14.

A typical progression of filling the cavities of the variable support portion 14 during the pregnancy of the user might be as follows. At the early stages of pregnancy before the user's stomach expands substantially, the user would likely fill the cylindrical member 22 and both annular members 20 and 21. As the pregnancy progresses and the user's stomach begins to expand, she may wish to partially or fully deflate the cylindrical member 22. As the stomach expands even further, the user will likely deflate the cylindrical member 22 and partially or fully deflate annular member 21. When the user's stomach is near full expansion, she will likely deflate the cylindrical member 22 and all of the annular members 20 and 21. The key to remember is that the user can tailor fit the variable support portion 14 such that her expanding stomach fits comfortably into the recess associated with a deflated portion of the variable support portion 14.

The thickness of the inflated fixed support portion 12 and the inflated portion of the variable support portion 14 must be great enough to establish a recess of sufficient depth in order to permit the user's extended stomach to fit therein. Of course, the dimension of this thickness is a function of the individual user. Also, note that the amount of material between the cylindrical member 22 and the annular member 21, between the annular members 21 and 20, and between the annular member 20 and the fixed support portion 12 must be of sufficient length to permit establishing a recess for receiving a portion of the user's protruded stomach. Again the definition of sufficient length may vary from one user to another.

The support apparatus 10 may be used as an air mattress, a floatation device or raft, or equivalents thereof. When used as an air mattress, a user may desire to place bedding sheets between themselves and the support device 10.

Although the invention has been particularly shown and described with reference to a preferred embodiment thereof, it will be understood by those skilled in the art that changes in form and detail may be made therein without departing from the spirit and scope of the invention. For example, while the support apparatus 10 has been described for use with pregnant users, it would work equally well for obese individuals.

What is claimed is:

1. An apparatus for supporting a user comprising, in combination:

fixed support means having a fixed configuration comprising a plurality of tubular member means each having a tubular cavity in communication with an adjacent, tubular cavity for inflating with a fluid for supporting a portion of said user;

variable support means coupled to and coplanar with said fixed support means and having a plurality of configurations for supporting a different abdominal portion of said user with each configuration of said plurality of configurations;

headrest member means comprising a single tubular member orthogonally coupled to said plurality of tubular member means and having an independent, tubular cavity for inflating with said fluid for supporting said user's head independent of providing support for other portions of said user and said headrest member being generally coplanar with said fixed support means;

a plurality of inflation means independently coupled to said fixed support means, said headrest member means, and said variable support means for inflating and sealing said fixed support means, said headrest member means, and said variable support means;

said variable support means comprising:

annular member means comprising a plurality of concentric, annular members each having an independent annular cavity and having an outer circumferential portion of said annular member means coupled to said fixed supporn means for selectively inflating with a fluid for supporting a first abdominal portion of said user; and cylindrical member means comprising a cylindrical member having an independent cylindrical cavity and having an outer circumferential portion coupled to an inner circumferential portion of said annular member means for selectively inflating with said fluid for supporting another abdominal portion of said user located adjacent said first abdominal portion of said user, said plurality of inflation means being in a straight line alignment with each other.

* * * * *